US010105856B2

(12) United States Patent
Tuijp et al.

(10) Patent No.: US 10,105,856 B2
(45) Date of Patent: Oct. 23, 2018

(54) HAIR CLIPPING DEVICE

(71) Applicant: KONINKLIJKE PHILIPS N.V., Eindhoven (NL)

(72) Inventors: Bram Tuijp, Eindhoven (NL); Martijn Frans Johan Nab, Eindhoven (NL); Everhardus Johannes Hoexum, Eindhoven (NL); Reinier Alexander Tijssen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 37 days.

(21) Appl. No.: 14/913,477

(22) PCT Filed: Aug. 18, 2014

(86) PCT No.: PCT/EP2014/067548
§ 371 (c)(1),
(2) Date: Feb. 22, 2016

(87) PCT Pub. No.: WO2015/028330
PCT Pub. Date: Mar. 5, 2015

(65) Prior Publication Data

US 2016/0207208 A1 Jul. 21, 2016

(30) Foreign Application Priority Data

Aug. 29, 2013 (EP) ..... 13182199

(51) Int. Cl.
*B26B 19/20* (2006.01)
*B26B 19/06* (2006.01)

(52) U.S. Cl.
CPC ..... *B26B 19/20* (2013.01); *B26B 19/06* (2013.01)

(58) Field of Classification Search
CPC ..... B26B 19/20; B26B 19/06; B26B 19/00; B26B 19/10; B26B 19/42; B26B 19/205
USPC ..... 30/201, 34.1, 200, 210, 216, 34.2, 43.1, 30/43, 123, 233.5, 202, 195, 233, 32; 132/137, 142, 157, 139; 15/187; D28/49–54
See application file for complete search history.

(56) References Cited

U.S. PATENT DOCUMENTS 1,503,986 A * 8/1924 Dean ..... B26B 19/20 30/200
2,941,293 A * 6/1960 Mazzoni ..... B26B 19/20 30/201

(Continued)

FOREIGN PATENT DOCUMENTS

CN 103231395 A 8/2013
DE 102004021503 B3 2/2006

(Continued)

*Primary Examiner* — Ghassem Alie

(57) ABSTRACT

A hair clipping device includes a housing, and a cutting assembly which is arranged on a distal end of the housing and which includes a stationary cutting blade and a moveable cutting blade. The hair clipping device includes further includes a comb attachment which is releasably attachable to the housing and includes a plurality of comb teeth. A front side of the housing that runs transverse to the distal end and the cutting assembly includes a corrugated surface with a plurality of adjacent ribs and recesses running parallel to each other. The backside of the comb teeth contacts the corrugated surface when the comb attachment is attached to the housing.

13 Claims, 10 Drawing Sheets

(56) References Cited

U.S. PATENT DOCUMENTS

| | | | | | |
|---|---|---|---|---|---|
| 3,287,805 | A | | 11/1966 | Charme | |
| 4,085,503 | A | | 4/1978 | Beck | |
| 4,138,809 | A | * | 2/1979 | Pires | B26B 19/20 30/200 |
| 4,614,036 | A | * | 9/1986 | Haraguchi | B26B 19/205 30/200 |
| 5,050,305 | A | * | 9/1991 | Baker | B26B 19/20 30/201 |
| 5,054,199 | A | | 10/1991 | Ogawa | |
| 5,084,974 | A | * | 2/1992 | Sukow | B26B 19/20 30/201 |
| 5,327,648 | A | * | 7/1994 | Ullmann | B26B 19/20 30/200 |
| 6,079,103 | A | * | 6/2000 | Melton | B26B 19/20 30/43.92 |
| 2003/0136006 | A1 | * | 7/2003 | Lin | B26B 19/20 30/195 |
| 2005/0138817 | A1 | | 6/2005 | Yamaguchi | |
| 2007/0204469 | A1 | | 9/2007 | Caric | |
| 2009/0188117 | A1 | | 7/2009 | Ptzer | |

FOREIGN PATENT DOCUMENTS

| | | | |
|---|---|---|---|
| EP | 2465652 | A1 | 6/2012 |
| GB | 2245211 | A | 1/1992 |
| JP | 60108074 | A | 6/1985 |
| JP | 05228270 | A | 9/1993 |

* cited by examiner

HAIR CLIPPING DEVICE

This application is the U.S. National Phase application under 35 U.S.C. § 371 of International Application No. PCT/EP2014/067548, filed on Aug. 18, 2014, which claims the benefit of International Application No. 13182199.3 filed on Aug. 29, 2013. These applications are hereby incorporated by reference herein.

FIELD OF THE INVENTION

The present invention relates to a hair clipping device, in particular to a hair clipping device with a comb attachment that is adapted to variably adjust the length of the haircut.

BACKGROUND OF THE INVENTION

Electric haircutting appliances are generally known and include trimmers, clippers and shavers whether powered by main supplied electricity or batteries. Such devices are generally used to trim body hair, in particular facial and head hair to allow a person to have a well-groomed appearance.

Commonly, conventional devices for cutting hair comprises a main body forming an elongated housing having a front or cutting end (also referred to as distal end) and an opposite handle end. A cutting assembly is disposed at the distal end. The cutting assembly usually comprises a stationary cutting blade and a movable cutting blade which moves in a reciprocal manner against the stationary cutting blade. The cutting assembly is usually fixed in a single position relative to the housing of the hair clipper, such that the orientation of the cutting assembly is determined by a user orientating the housing or main body of the hair clipping device. The tips of the cutting teeth of the cutting assembly (of the stationary cutting blade and the movable cutting blade) usually jut out of the front side of the hair clipper housing, such that the tips of the teeth are always visible to the user. This makes it easier for the user to see where exactly the hairs are cut, which is specifically advantageous when using the hair clipper to form and create fine hair contours.

Since there is a great user demand for hair clipping devices that offer the possibility to be used for different haircut lengths, many known hair clipping devices make use of separate, differently sized comb attachments. These comb attachments are generally mounted to the distal end of a conventional hair clipping device to position the cutting assembly relative to the skin. In other words, such a comb attachment is used as a guide that moves over the skin and guides hair towards the cutting assembly. Typically, these comb attachments are mounted over the cutting assembly and spaces the cutting blades apart from the surface of the skin from which the hairs extend. However, always having to replace the comb attachment by a different one when the haircut length shall be changed might be cumbersome for the user, as this is not only time consuming, but the user also has to store a plurality of differently sized comb attachments.

Therefore, a lot of prior art hair clipping devices use only one comb attachment that is adjustable in different positions relative to the hair clipper housing. Users may thus shift the comb attachment between different positions leading to different haircut lengths. Usually these movable comb attachments may be adjusted between haircut lengths of 3 mm, 5 mm, 7 mm, 9 mm, usually up to 10 mm.

One of the major problems that arises when using hair clippers in combination with a comb attachment is the so-called clogging effect. This clogging effect arises for stationary combs as well as for adjustable/movable combs. The clogging effect results from an accumulation of already cut hairs which get trapped and stuck in between the housing and the comb teeth. Once hairs are entangled in between the housing and the comb teeth, they start collecting more and more cut hairs which finally causes a built-up of already cut hairs and is perceived by the consumer as clogging. This of course hampers a precise haircut and might even lead to a blockage that jams and/or damages the cutting assembly.

DE 34 41 060 A1 discloses a hair clipper with a comb attachment that is especially designed for preventing such a clogging effect. The therein shown comb attachment comprises a plurality of barbed hooks that are disposed on the upper surfaces of the comb teeth. These barbed hooks act as a blockade that hinders the already cut hairs from getting back to the tooth tips of the cutting assembly and from getting stuck in between the hair clipper housing and the comb attachment.

DE 40 39 681 A1 discloses a hair clipper with a main cutting assembly and an additional trimming unit.

There is, however, still room for improvement, especially for preventing the clogging effect in an efficient manner.

SUMMARY OF THE INVENTION

It is an object of the present invention to provide a hair clipping device which overcomes the above-mentioned problems. In particular, it is an object to provide an improved hair clipping device that prevents an accumulation of cut hairs between the housing of the hair clipping device and a comb attachment that is attached thereto. It is furthermore an object to increase the visibility of the tips of the cutting assembly for the user while at the same time minimizing the amount of hair that can be trapped under the comb attachment in order to prevent the unwanted clogging effect that has been described above.

This problem is solved by a hair clipping device comprising:

- a housing,
- a cutting assembly which is arranged on a distal end of said housing and comprises a stationary cutting blade and a moveable cutting blade,
- a comb attachment which is releasably attachable to the housing and comprises a plurality of comb teeth, wherein a front side of the housing that runs transverse to the distal end and the cutting assembly and comprises a corrugated surface with a plurality of adjacent ribs and recesses running parallel to each other, and wherein a front side of the comb teeth faces away from the housing and an opposing backside of the comb teeth contacts the corrugated surface when the comb attachment is attached to the housing.

Preferred embodiments of the invention are defined in the dependent claims. It shall be understood that the claimed hair clipping unit has similar and/or identical preferred embodiments as the claimed hair clipping device and as defined in the dependent claims.

The presented hair clipper and the comb attachment are configured such that the backside of the comb teeth contacts the front side of the hair clipper housing. In contrast to known devices there is therefore no gap in between the backside of the comb attachment and the front side of the housing to which the comb attachment is attached. Already cut hairs may not get trapped in between the backside of the comb attachment and the front side of the housing. Thus, there is a low chance for already cut hairs to get collected in between the comb teeth and the housing of the hair clipper.

This efficiently prevents clogging of cut hairs in between the comb teeth as well as in between the housing and the backside of the comb attachment.

Due to this contact between the backside of the comb attachment and the front side of the housing, the transportation of the already cut hairs is also improved. Cut hairs are automatically pushed out of the comb attachment in between the comb teeth without having the chance to get entangled in between the comb attachment and the housing. Since the cut hairs do not get trapped in between these two parts anymore, haircutting is improved, which results in a more even haircut.

One of the main features of the presented hair clipping device is the corrugated surface which is arranged on the front side of the hair clipper housing. Said corrugated surface comprises a plurality of adjacent ribs and recesses which run parallel to each other. These ribs and recesses preferably run substantially parallel to a longitudinal direction of the housing. The corrugated surface allows the comb attachment to get directly into contact with the hair clipper housing. The ribs and recesses provided therein have mainly two advantages.

On the one hand, the recesses may function as receiving slots for at least partly receiving the backside of the comb teeth. The comb teeth may therefore be at least partly recessed within the housing, such that the comb attachment is arranged even closer with respect to the housing. This does not only prevent the unwanted clogging effect, but also increases the stiffness of the comb teeth, as this will be explained further below.

On the other hand, the ribs allow the user to still see the tips of the cutting teeth of the cutting assembly even though the backside of the comb teeth of the comb attachment touches the front side of the housing. The user may in this case still see the tips of the cutting teeth of the cutting assembly through the recesses that are provided in between the ribs, which is especially advantageous when using the hair clipper without comb attachment for precise hair contouring. This will become clear by the explanation provided further below.

Depending on the embodiment, the backside of the comb teeth of the comb attachment may therefore either contact the top surface of the ribs or the ground of the recesses. It is to be noted that the terms "ribs" and "recesses" are to be understood as relative terms. The recesses are recessed with respect to (relative to) the apex of the ribs. Such ribs and recesses may be created by either providing parallel slots into a flat surface, such that the slots form the recesses and the space in between the slots form the ribs, or by providing ribs onto a flat surface, such that the ribs jut out of said flat surface and the space in between the ribs forms the recesses. In any case, each rib adjoins two recesses and each recess adjoins two ribs, i.e. the ribs and recesses are arranged parallel to each other in an alternating manner (rib-recess-rib-recess etc.).

In a preferred embodiment of the present invention, the hair clipping device further comprises an adjustment mechanism for adjusting the position of the comb attachment relative to the housing along a longitudinal direction of the ribs and recesses.

This allows having a single comb attachment on the hair clipping device which is adjustable in length settings depending on the user's needs. The adjustment mechanism preferably allows to adjust the length settings starting at 1 mm up to 21 mm. The adjustment mechanism may either be configured to allow a length setting in predefined steps, e.g. steps of one millimeter, or to allow a stepless setting over the whole range of e.g. 1 to 21 mm.

The adjustment mechanism may be realized by two guiding rails provided on the front side of the hair clipper housing which engage with two corresponding guiding rails arranged on the comb attachment. The guiding rails may however also be provided on the lateral sides of the housing. Likewise it is also possible to realize the adjustment mechanism as a ratchet-type guiding rail.

According to a preferred embodiment, the adjustment mechanism is configured to set the comb attachment in a plurality of different positions relative to the housing, wherein the backside of the comb teeth contacts the corrugated surface in each of said plurality of positions.

In other words, this means that the backside of the comb teeth constantly touches the corrugated surface provided on the front side of the housing independent of the length setting. While changing the length setting, the backside of the comb attachment constantly slides over the corrugated surface of the front side of the clipper housing and moves along the longitudinal direction of the ribs and recesses in a parallel movement over the whole range. Consequently, it is for all length settings prevented that hairs get entangled in between the comb attachment and the housing of the hair clipper.

According to a further embodiment, the comb teeth of the comb attachment run parallel to the ribs and recesses when the comb attachment is attached to the housing. The tips of the cutting teeth of the cutting assembly are therefore still visible even when the comb attachment is attached to the housing. Furthermore, this arrangement increases the stability of the connection between the comb and the housing, since the backside of each comb tooth contacts either the upper side of the ribs or the ground of the recesses. This contact between the backside of the comb teeth and the corrugated surface on the front side of the housing is not only a contact at specific points but at least a line contact between each comb tooth and rib or recess, respectively.

According to a further preferred embodiment, the comb teeth of the comb attachment are at least partly received within the recesses when the comb attachment is attached to the housing, such that the backside of each comb tooth contacts a base of a respective one of the recesses. This further improves the stiffness of the individual comb tooth that are spaced apart from each other, because each comb tooth is fixed within and supported by the housing. The improved stiffness of the comb teeth is especially advantageous, since it allows to create an even haircut. Even if the comb teeth bend away from the housing due to the force with which the comb attachment is pressed onto the user's head, the gap between the front side of the hair clipper housing and the backside of the comb attachment remains closed, since the comb teeth are also in this case at least partly received within the provided recesses. The recesses in this embodiment so to say function as receiving slots, wherein each recess receives one of the comb teeth of the comb attachment. The unwanted clogging effect is therefore effectively prevented.

According to a further preferred embodiment, each of the comb teeth of the comb attachment has a width that substantially equals a width of the recesses. It has to be noted that said width denotes the lateral dimension of the comb teeth and the recesses measured perpendicular to the longitudinal direction of the comb teeth and the recesses.

If the width of the comb teeth is adapted to the width of the recesses, the stability of the interface between the comb attachment and the hair clipper housing is further improved.

Next to lowering the amount of clogging, the stiffness of each individual comb tooth is improved in the direction perpendicular to each comb tooth because of the guidance and support of the housing. This improved stiffness leads to an even haircut and a more robust quality perception of the comb attachment and the hair clipping unit. Due to the reception of the comb tooth within the recesses of the corrugated surface of the housing, the comb teeth may no longer flex to the sides that much. The chance of cut hairs getting collected in between the comb teeth and the front side of the housing is thus even more effectively prevented.

The above-mentioned stiffening arrangement is preferably realized by having ribs that jut out of the front side of the housing. In this way, the recesses are formed in between the ribs, wherein each recess has two lateral flanks that contact the side surfaces of the comb teeth and stabilize them.

In another embodiment of the present invention, the backside of each comb tooth contacts an upper side of a respective one of the ribs when the comb attachment is attached to the housing.

In contrast to the first embodiment mentioned above, the backside of the comb teeth contacts the upper side of the ribs instead of being recessed within the recesses of the corrugated surface on the front side of the hair clipper housing. In this case each of the comb teeth of the comb attachment preferably has a width that substantially equals or exceeds a width of the ribs. Again, said width denotes the dimension measured perpendicular to the longitudinal direction of the ribs. Besides the clogging prevention, said embodiment provides the advantage that the tips of the cutting teeth of the cutting assembly are all the time visible to the user, since the user can see said cutting tooth tips by looking through the recesses even when the comb attachment is attached to the housing of the hair clipper. The comb teeth then contact the apex of the ribs, whereas the space in between the comb teeth runs parallel to the recesses, such that the user may see the tip of the cutting assembly through the space in between the comb teeth of the comb attachment. This improved visibility is not only a design issue. It also facilitates the haircut for the user, since the user exactly sees how the cutting teeth of the cutting assembly are orientated with respect to his/her head.

According to the above-mentioned embodiment, it is preferred that the stationary cutting blade comprises a plurality of cutting teeth, wherein each of the ribs comprises an upper side facing away from the housing, and wherein an imaginary plane in which said upper side is arranged contacts a tip of the cutting teeth of the stationary cutting blade.

It is to be noted that said imaginary plane is herein only described for illustrative purposes. The above-mentioned features in other words mean that the tips of the cutting teeth of the cutting assembly are on the same level as the upper side or apex of the ribs. This again means that the comb attachment does not contact the cutting assembly when being attached to the trimmer housing, wherein the backside of the comb teeth contacts the upper side or apex of the ribs. The ribs therefore block the entrance for cut hairs to get in between the comb attachment and the front side of the housing. On the other hand, the cutting teeth of the cutting assembly are still visible to the user, since the space in between the ribs is recessed with respect to the tips of the cutting teeth. The parts of the corrugated surface on the front side of the housing that are not in contact with the comb teeth (i.e. the recesses) are therefore retracted and not on the same level with the tips of the cutting teeth of the cutting assembly.

This embodiment solves the contradictory requirements to increase the precision of the haircut for fine contours, while at the same time trying to prevent the above-mentioned clogging effect.

With the corrugated surface on the front side of the hair clipper housing, this contradiction is, however, solved. The comb teeth may contact the ribs of said corrugated surface for preventing clogging, while the tips of the cutting blades are still visible due to the recesses that are provided in between the ribs. This significant advantage will become even more apparent from the drawings and the accompanying description provided further below.

According to a further embodiment of the present invention, the comb attachment comprises two arms that stand out of the backside of the comb attachment, one arm at each lateral side of the comb attachment, such that said arms overlap the distal end of the housing when the comb attachment is attached to the housing, and wherein the space in between said two arms is left open.

In this embodiment an open space is created on the side of the comb that usually covers the distal end of the hair clipper housing. Said open space in between the two arms allows cut hairs to fall down (so that they do not clog) and left over hairs not affecting the cutting performance negatively. This further improves the cutting efficiency. The uncut hairs in this way have a free hair flow out of the comb, because the bottom side of the comb is open in between the two arms. Especially when cutting longer hairs, this is creating a free hair flow without manipulating the uncut hairs which could otherwise get entangled on the bottom side of the comb attachment when falling down after being cut.

The described two arms that are provided on the left and right side of the bottom side of the comb mainly have the function to increase the stability. These two arms serve as bars that allow placing the hair clipping device with the comb on the user's head. Without these two bars it would be hard for the user to create an even haircut with the comb, since guidance for placing the comb correctly relative to the user's head would be missing otherwise.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
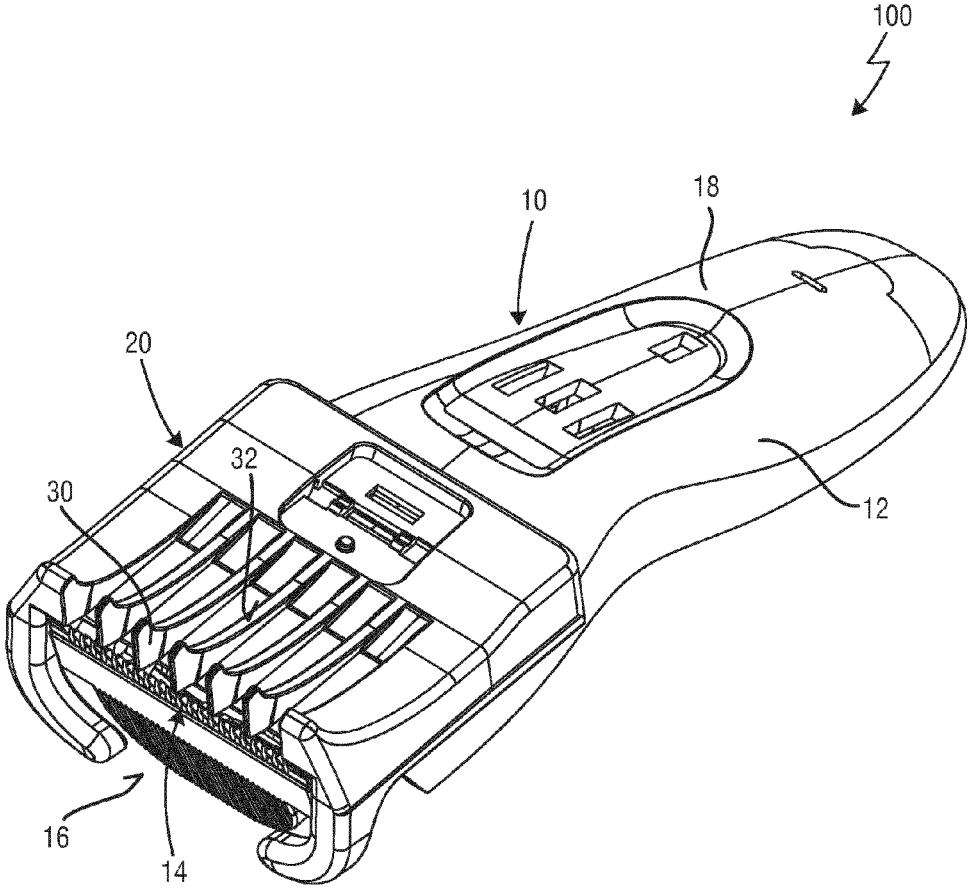
FIG. 1 shows a perspective view of a hair clipper according to the present invention with a comb that is attached thereto.
Figure 2:
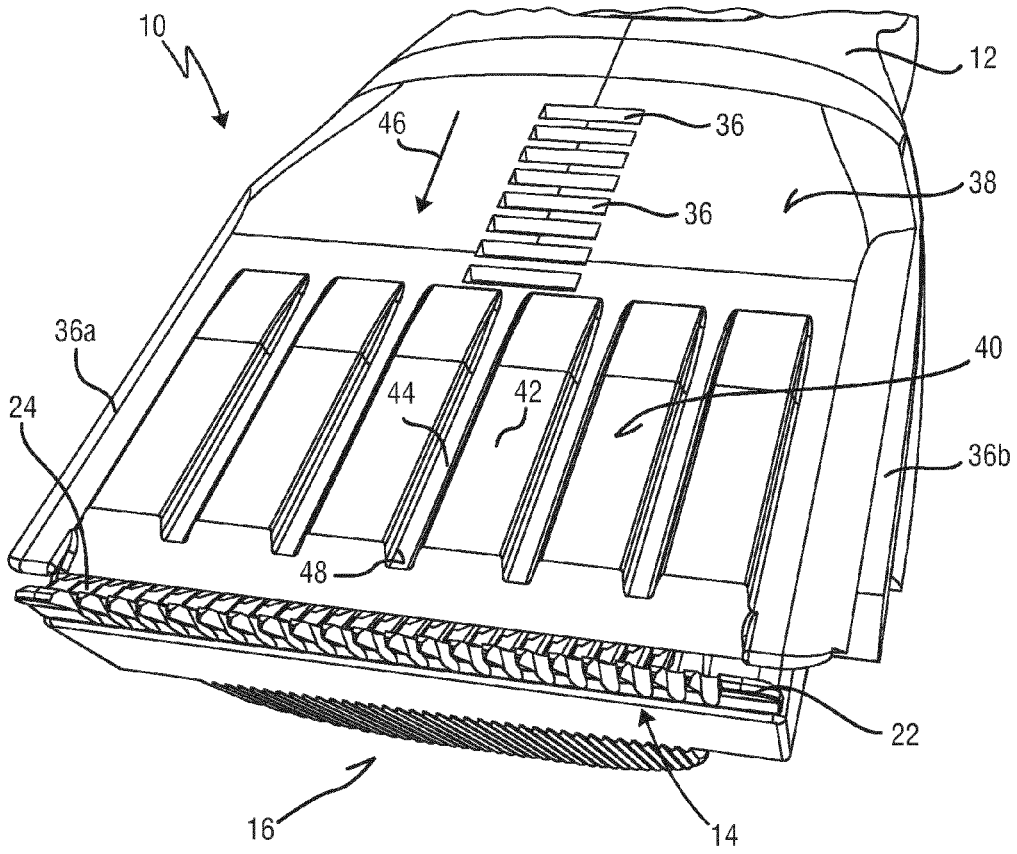
FIG. 2 shows an enlarged view of the hair clipper housing according to a first embodiment of the present invention.

FIGS. 1 and 2 show a first embodiment of the hair clipping device according to the present invention. The hair clipping device is therein in its entirety denoted with reference numeral 100.

The hair clipping device 100 comprises a hair clipper 10 (also denoted as hair clipping unit 10) as well as a comb attachment 20 that is releasably attachable to the hair clipper 10. FIG. 1 shows the hair clipping device 100 with the comb 20 attached to the hair clipper 10, whereas FIG. 2 shows an enlarged view of a front end of the hair clipper 10 without comb 20 attached thereto.

The hair clipper 10 comprises a housing 12 in which all remaining parts are usually integrated and to which the comb 20 may be attached. The housing 12 also serves as a holder for a cutting assembly 14. This cutting assembly 14 may be releasably fixed to a distal end 16 of the housing 12. The cutting assembly 14 may, however, also be permanently fixed to the distal end 16 of the housing 12. The housing 12 is usually realized as an elongated body that forms a handle 18 at its rear end.

The cutting assembly 14 includes a stationary cutting blade 22 and a movable cutting blade 24. The movable cutting blade 24 is in the known manner displaceably mounted on an upper surface of the stationary cutting blade 22. By the help of one or more springs (not shown), the movable cutting blade 24 is resiliently biased against the stationary cutting blade 22. This spring exerts a spring force onto the movable cutting blade 24 in order to keep the two cutting blades 22, 24 close together. Both cutting blades 22, 24 each comprise a cutting edge with a plurality of cutting teeth 26, 28.

During operation haircutting is performed by the interaction of the stationary cutting blade 22 and the movable cutting blade 24 that reciprocates on the stationary cutting blade 22 as this is known from other conventional hair clipping devices.

The stationary cutting blade 22 is usually designed to be thicker than the movable cutting blade 24. Said stationary cutting blade 22 is also denoted as "guard". In order to receive a good cutting performance, the movable cutting blade 24 is actively pressed onto the upper surface of the guard 22 to receive a so-called teeth pressure. This teeth pressure is, inter alia, guaranteed by the above-mentioned spring that presses the two cutting blades 22, 24 together.

A drive arrangement including a motor (not shown) is adapted to drive the movable cutting blade 24 in an oscillatory manner relative to the stationary cutting blade 22. The motor itself is usually realized as an electric motor that is either powered by main supplied electricity or battery-driven.

Depending on the desired haircut length that shall be achieved, the hair clipping device 100 may either be used with or without comb attachment 20. Especially when longer haircuts are desired, the comb 20 may be attached to the distal end 16 of the housing 12. As shown in FIG. 1, the comb attachment 20 is thereby mounted over the cutting assembly 14 and spaces the cutting blades 22, 24 apart from the surface of the skin from which the hairs extend. It so to say acts as a spacer between the user's head and the cutting assembly 14, so that the resulting length of the haircut is increased compared to a usage of the hair clipper 10 without comb attachment 20.

The comb attachment 20 comprises a plurality of spaced-apart comb teeth 30 which are arranged in parallel to each other. In the exemplary embodiment shown in FIG. 1, five comb teeth 30 are provided. However, it shall be understood that the comb attachment 20 may also comprise more or less than five comb teeth 30. In the mounted state the front side 32 of the comb teeth 30 faces away from the housing 12, whereas the backside 34 of the comb teeth 30 faces towards the housing 12 (see FIG. 4).

The comb attachment 20 is preferably designed as a displaceable comb, so that different haircut lengths may be achieved with one and the same comb attachment. The hair clipping device 100 thereto comprises an adjustment mechanism that allows to adjust the position of the comb attachment 20 relative to the housing 12 along the longitudinal direction of the comb teeth 30. In the shown embodiment this is realized by two guiding rails 36*a, b* that are arranged on the lateral sides of the housing 12 (see FIG. 2) and two corresponding guiding rails (not shown) arranged on the inner side of the comb attachment 20. Furthermore, a plurality of spaced-apart locking recesses 36 may be provided on the front side 38 of the housing 12. These locking recesses 36 allow the comb 20 to be locked in different positions relative to the housing 12 in a manner similar as a ratchet.

It is to be noted that the adjustment mechanism for adjusting the position of the comb attachment 20 relative to the housing 12 may be realized in a variety of other ways. Instead of the shown stepwise setting, other adjustment mechanisms are conceivable as well that allow to steplessly adjust the comb 20 relative to the housing 12.

One of the central points of the present invention relates to the interface between the comb attachment 20 and the hair clipping unit 10. This interface is designed in a way to prevent clogging of cut hairs, i.e. to prevent that already cut hairs get entangled and trapped in between the comb attachment 20 and the housing 12. For this purpose the housing 12 comprises a corrugated surface 40 that is arranged on the front side 38 of the housing 12. It is to be noted that said front side 38 of the housing 12 shall denote the upper side of the housing 12 which runs transverse to the surface provided at the distal end 16 that falls together with the bottom side of the cutting assembly 14.

In the context of this invention 'transverse' is not understood as perpendicular. It will be clear to the skilled person that the term transverse should be understood as non-parallel. The corrugated surface 40 comprises a plurality of adjacent ribs 42 and recesses 44 that run in between the ribs 42. The ribs 42 and recesses 44 of the corrugated surface 40 extend parallel to each other, wherein both are preferably arranged substantially parallel to the longitudinal direction 46 of the housing 12.

Figure 3:
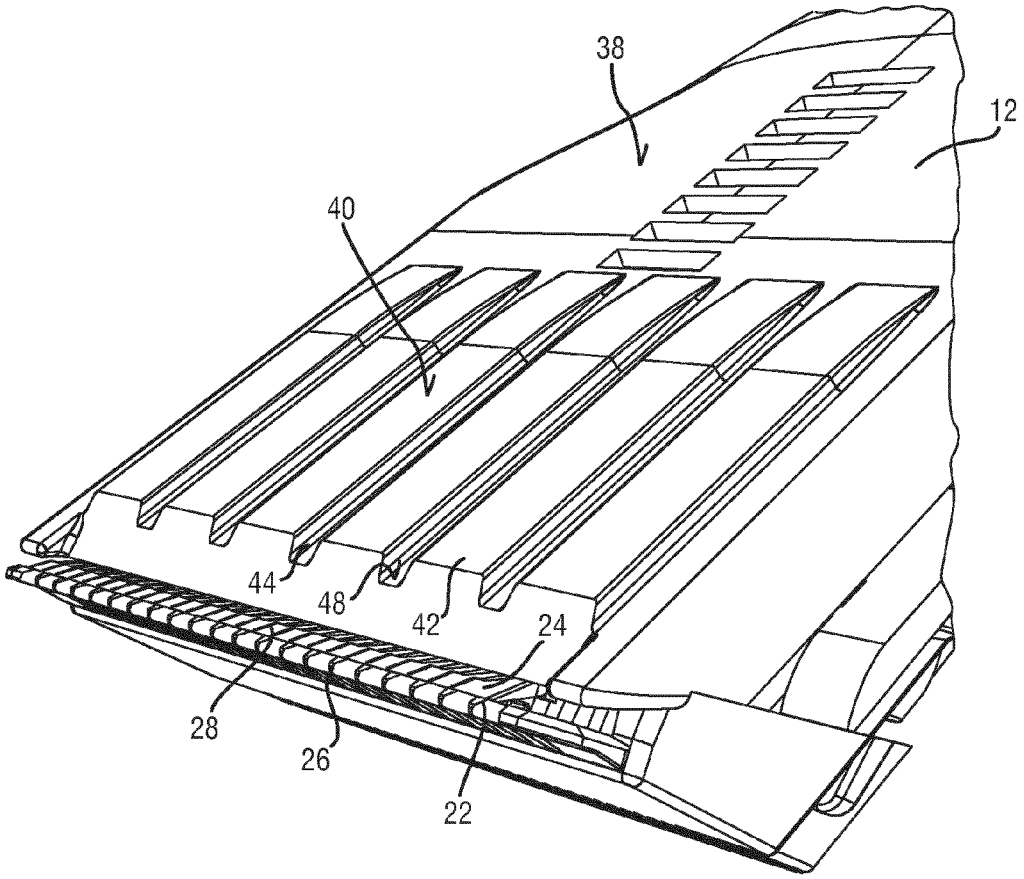
FIG. 3 shows the hair clipper housing according to the first embodiment of the present invention from the side.
Figure 4A:
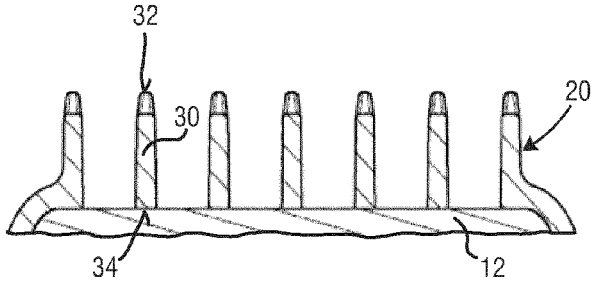
FIG. 4 schematically illustrates the technical principle and the advantages of the first embodiment.
Figure 4B:
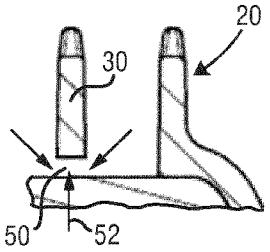
Figure 4C:
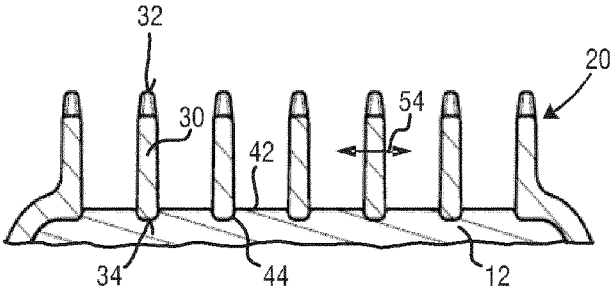
Figure 4D:
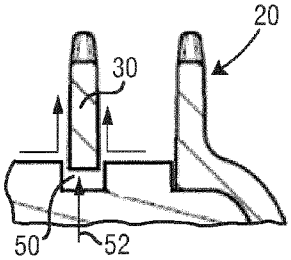

As it can be seen in FIGS. 2 and 3, the ribs 42 jut out of the front or upper side 38 of the housing 12. The recesses 44 are arranged in between these protruding ribs 42. According to the first embodiment shown in FIGS. 2 and 3, the width of the recesses 44 is adapted to the width of the comb teeth 30, i.e. the recesses 44 have approximately the same width as the comb teeth 30.

In this first embodiment the recesses 44 are designed as receiving slots for at least partly receiving the comb teeth 30 of the comb attachment 20. Each comb teeth 30 preferably contacts with its backside 34 a base surface 48 of a respective recess 44 when the comb attachment 20 is attached to the hair clipper 10. Said base surface 48 forms the ground of the respective recess 44. According to the first embodiment, this base surface 48 is preferably arranged parallel or in plane with the front side 38 of the housing 12.

The fact that the comb teeth 30 are attached to and received within the recesses 44 has the following advantages, which may be best seen in the schematical illustration shown in FIG. 4. First of all, if the backside 34 of the comb teeth 30 contacts the front side 38 of the housing, there appears no gap in between the comb 20 and the housing 12. If there is no gap in between these two parts, there is a low chance that hairs get collected in between the comb teeth 30 and the housing 12. This prevents an accumulation of cut hairs in between these two parts and reduces the risk for an unwanted clogging effect of cut hairs in the comb 20 which could lead to a blockage of the cutting assembly 14. This situation is exemplarily shown in FIG. 4A.

The comb teeth 30 are usually made of a flexible material, e.g. plastic. Thus, there is a high chance that the comb teeth 30 slightly bend away from the housing 12 as soon as a force is applied thereto during use. During use the user usually presses the comb attachment 20 against his head, which can lead to bending moments that causes the comb teeth 30 to slightly bend away from the front side 38 of the housing 12. This may cause a small gap 50 in between the backside 34 of the comb teeth 30 and the front side 38 of the housing 12. Cut hairs may then enter in between the comb teeth 30 and the housing 12 from the front direction as well as from the two sides (indicated in FIG. 4B by arrows 52). Once hairs are in between the comb teeth 30 and the housing 12, they start collecting more and more cut hairs which finally causes a built-up of hairs and is perceived by the consumer as clogging.

The corrugated surface 40 with its ribs 42 and recesses 44 prevents this clogging effect. As explained above with reference to FIGS. 2 and 3, the comb teeth 30 are according to the first embodiment of the present invention at least partly received within the recesses 44 (see FIG. 4C). If the comb teeth 30 now bend away during use of the hair clipping device 100, the gap 50 remains closed on the sides of each comb tooth 30 (see arrows 52 in FIG. 4D). In this way the only chance for hairs to enter is the front direction. This significantly reduces the chance of cut hairs entering in between the comb attachment 20 and the housing 12. Experiments of the applicant have shown that the chance of cut hairs getting entangled in between the comb 20 and the housing 12 is in this way decreased by factor 2 or even more.

Besides being less sensitive for clogging, this embodiment furthermore provides the advantage of creating a more robust interface between the comb teeth 30 and the housing 12. By being received within the recesses 44, the stiffness of each individual comb tooth 30 is improved because of the guidance that the recesses 44 provide to the comb teeth 30. The comb teeth 30 do not flex that much anymore in a direction perpendicular to the longitudinal direction of each comb tooth 30 (illustrated by arrow 54 in FIG. 4C). This improved stiffness leads to an even haircut and a more robust quality perception of the comb 20 and therefore also of the whole hair clipping device 100.

Figure 5:
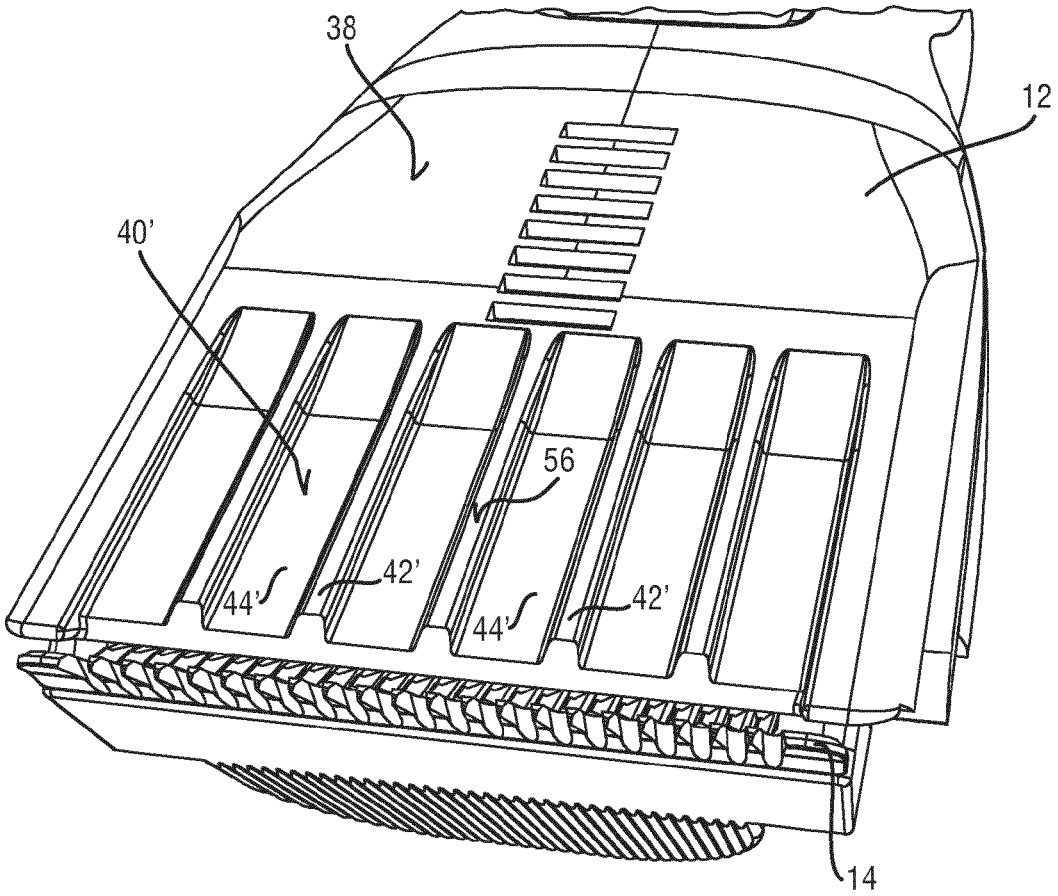
FIG. 5 shows an enlarged view of the hair clipper housing according to a second embodiment of the present invention.
Figure 6:
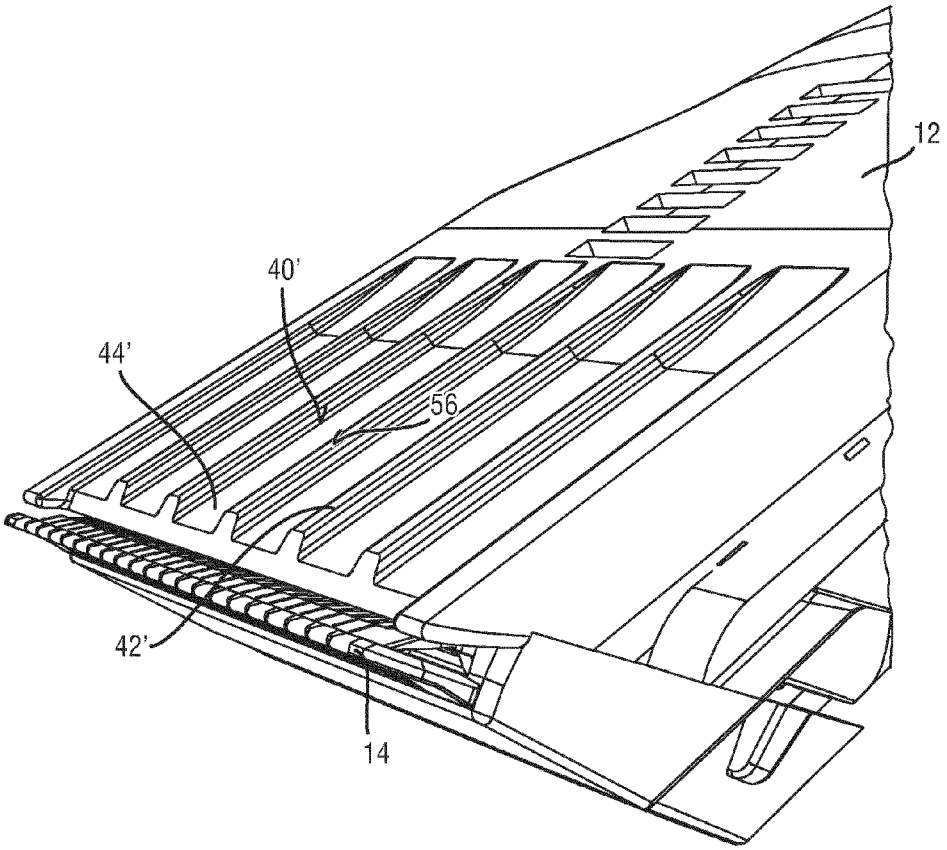
FIG. 6 shows the hair clipper housing according to the second embodiment from the side.

FIGS. 5 and 6 show a second embodiment of the hair clipping device 100 according to the present invention. This embodiment also comprises a corrugated surface 40' on the front side 38 of the housing 12. Said corrugated surface 40' is slightly modified compared to the corrugated surface 40 according to the first embodiment shown in FIGS. 2 and 3. It still comprises a plurality of ribs 42' and recesses 44' that run parallel to each other. The corrugated surface 40' is however formed exactly the way around compared to corrugated surface 40. In this case, the width of the recesses 44' is larger than the width of the ribs 42'. The width of the ribs 42' is adapted to the width of the comb teeth 30, i.e. the width of the ribs 42' is almost or exactly equal to the width of the comb teeth 30. The ribs 42' do no longer jut out of the front side 38 of the housing 12, but are in plane with said front side 38. The recesses 44' are recessed with respect thereto. Corrugated surface 40' could therefore also be considered as a negative of corrugated surface 40.

In this second embodiment the backside 34 of the comb teeth 30 contacts the ribs 42' (instead of contacting the recesses 44 as in the first embodiment) when the comb attachment 20 is attached to the hair clipper 10. In particular, the backside 34 of the comb teeth 30 is in this embodiment configured to contact an upper surface 56 that forms the apex of the longitudinal ribs 42'.

First of all, this means that also according to the second embodiment shown in FIGS. 5 and 6 the backside 34 of the comb 20 is still in direct contact with the housing (with the corrugated surface 40'), so that there appears no gap in between the comb 20 and the housing 12. This direct contact again prevents hairs to get trapped in between the housing 12 and the comb 20. This second embodiment additionally provides the advantage that it increases the visibility of the cutting assembly 14 to the user. This is especially the case when solely using the hair clipper 10 without comb attachment 20.

When using the hair clipper 10 without comb attachment 20 for cutting precise hair contours, e.g. for trimming moustaches, side burns, etc., it is important that the cutting assembly 14 is clearly visible to the user. Otherwise, the user would not clearly see the contour that is cut by the hair trimmer, which would significantly impede the handling of the device. Precision is therefore linked to the visibility of the cutting tips of the cutting assembly 14. This visibility depends on the distance between the tips of the cutting teeth 26, 28 and the front side 38 of the housing 12. In other words, the more the tips of the cutting elements 26, 28 stand out from the front side 38 of the housing 12, the better they are visible to the user and the easier is the handling when using the hair clipper 10 for contouring. On the other hand, it is one of the main targets of the present invention to prevent the above-mentioned clogging effect, which is, as already explained above, achieved by a direct contact between the backside 38 of the comb 20 and the front side 38 of the housing 12.

Both requirements, increasing the visibility of the cutting assembly 14 and preventing the clogging effect, could not be met without the corrugated surface 40' that is shown in FIGS. 5 and 6. Having only a flat surface provided on the front side 38 of the housing 12 would either lead to a solution where the comb attachment 20 may contact the housing 12 but the cutting assembly 14 is not visible to the user or to a solution where the cutting assembly 14 is visible to the user but where the comb attachment 20 could not directly contact the front side 38 of the housing 12, as this would otherwise cause a collision of the backside 34 of the comb teeth 30 with the cutting assembly 14.

Figure 7A:
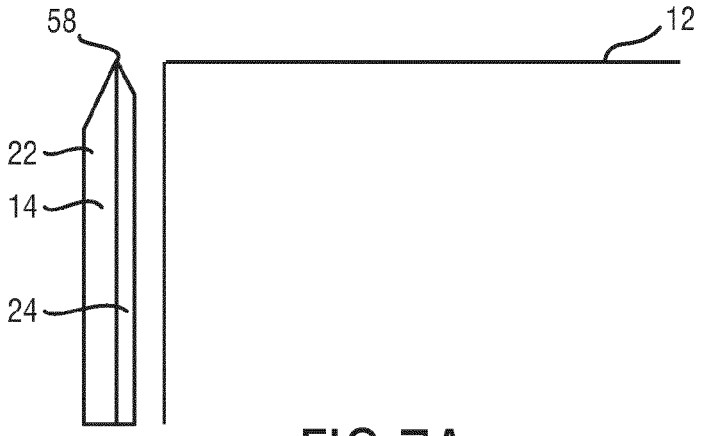
FIG. 7 schematically illustrates the technical principle and the advantages of the second embodiment.
Figure 7B:
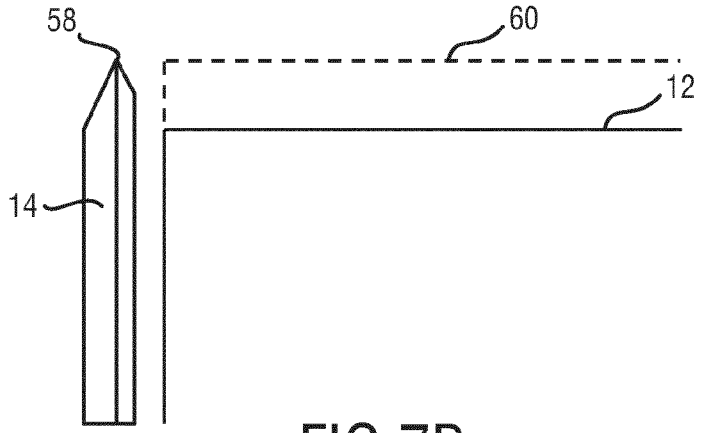
Figure 7C:
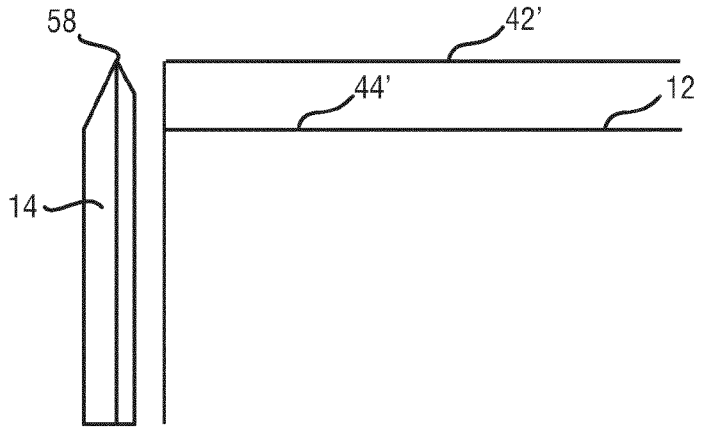

The corrugated surface 40' provided on the front side 38 of the housing 12 however solves this contradiction, so that one and the same solution allows to prevent the clogging effect and at the same time increases the visibility of the cutting assembly 14. This may be best explained by means of the schematical drawings provided in FIG. 7. When only providing a flat front surface of the housing 12 and still wanting to prevent the clogging effect, the tips 58 of the cutting blades 22, 24 should be on the same level as the front side 38 of the housing 12 in order to prevent a collision between the comb 20 and the cutting assembly 14 when the comb 20 directly contacts the housing 12. In this situation the tips of the cutting blades 22, 24 would however not be visible to the user (as schematically illustrated in FIG. 7A). To increase the visibility of the tips of the cutting assembly 14, the cutting blades 22, 24 should thus stand out of the front side 38 of the housing 12 (as shown in FIG. 7B). However, this again bears the problem that when a comb 20 is attached to the housing, cut hairs may gather in the area between the comb teeth 30 and the device housing 12. This area is schematically shown in FIG. 7B by means of a dotted line 60 and may be called "cut out area" or "indentation area".

The gist of the second embodiment shown in FIGS. 5 and 6 is now to fill this cut out area 60 with the ribs 42' of the corrugated surface 40', wherein the ribs 42' having approximately the same height as the cut out area 60. The upper surface or apex 56 of the ribs 42' is then on the same level with the tips 58 of the cutting blades 22, 24. The recesses 44' are, however, recessed with respect thereto, so that the front of the cutting assembly 14 is still visible to the user.

Figure 8A:
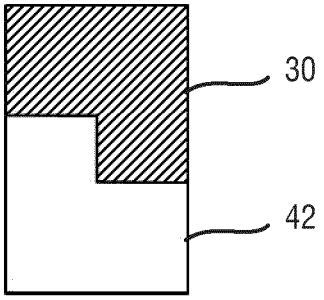
FIG. 8 schematically shows a variety of possible exemplary cross-sections of ribs and recesses.
Figure 8B:
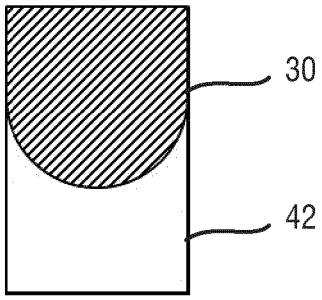
Figure 8C:
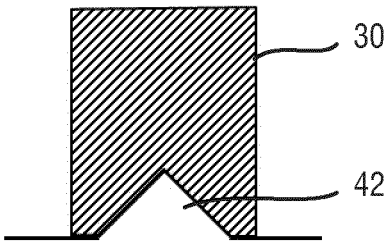
Figure 8D:
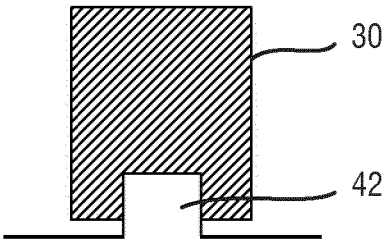

Furthermore, it shall be noted that the ribs 42, 42' and the recesses 44, 44' can have a variety of different cross-sections without departing from the scope of the present invention. The ribs 42, 42' and the recesses 44, 44' do not necessarily have to have a rectangular cross-section. As shown in FIGS. 8A-8D the ribs 42, 42' may, for example, also have a step-shaped cross-section (as shown in FIG. 8A), a round cross-section (as shown in FIG. 8B), a triangular cross-section (as shown in FIG. 8C) or a quadratic cross-section (as shown in FIG. 8D), while still maintaining the technical principal. As it also becomes clear from FIG. 8, the cross-section of the comb teeth 30 is preferably adapted to the cross-section of the ribs 42, 42' and/or the recesses 44, 44' (as a counterpart). For simplicity reasons FIG. 8 only shows four conceivable cross-sections of the 42, 42'. The skilled person will, however, notice that the recesses 44, 44' may have similar cross-sections. As already pointed out before, the recesses 44, 44' are nothing else than the space between the ribs 42, 42' in the corrugated surface 40, 40'. This means that as soon as the cross-section of the ribs 42, 42' is changed, the cross-section of the recesses 44, 44' is changed correspondingly. Still further, it is to be noted that the exemplary different cross-sections shown in FIGS. 8A-8D may be implemented in both embodiments (first embodiment shown in FIGS. 2 and 3 as well as second embodiment shown in FIGS. 5 and 6). The skilled person will also notice that a plurality of further cross-sections are possible by still maintaining the above-mentioned inventive principle.

Figure 9:
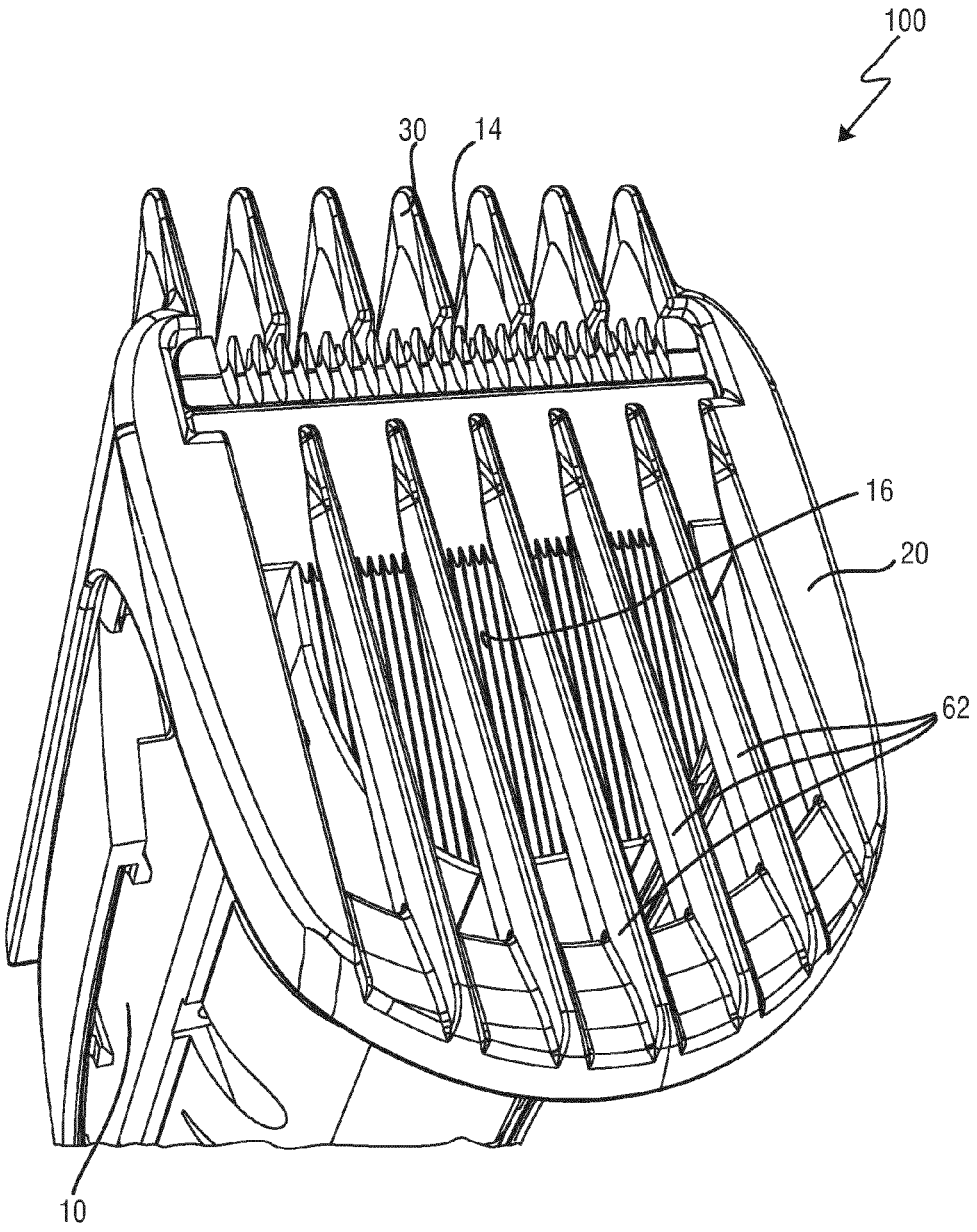
FIG. 9 shows an enlarged view of a first embodiment of a comb attachment according to the present invention.
Figure 10:
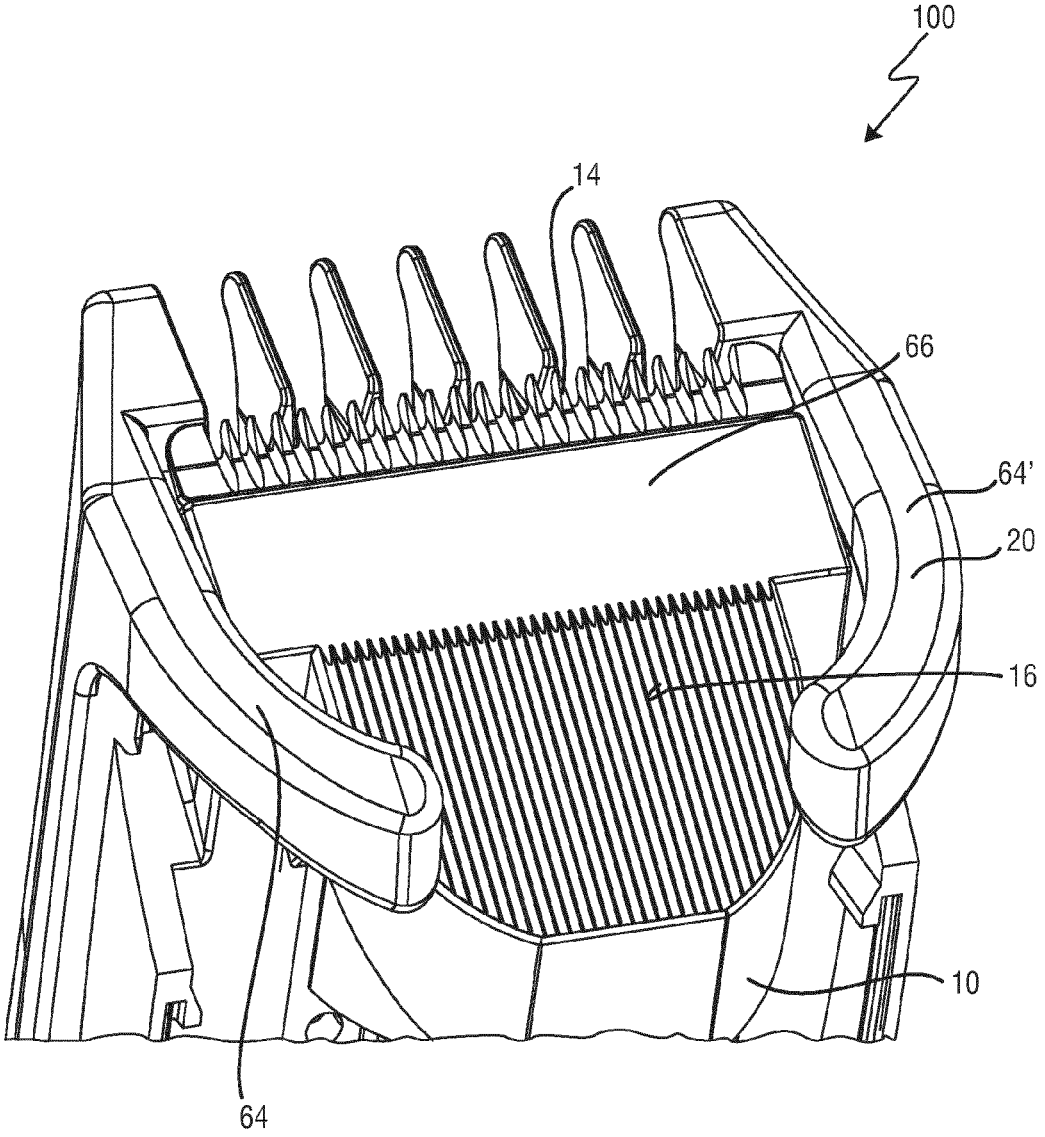
FIG. 10 shows an enlarged view of a second embodiment of the comb attachment according to the present invention.

FIGS. 9 and 10 show two different embodiments of the comb attachment 20. The hair clipping device 100 including the hair clipper 10 and the comb 20 are therein shown from the bottom, i.e. looking at the distal end 16 of the housing 12.

According to the first embodiment shown in FIG. 9, the comb attachment 20 comprises a plurality of bottom ribs 62 (also denoted as bottom comb teeth 62) that run parallel to the comb teeth 30 and cover the distal end 16 of the housing 12 when the comb 20 is attached to the hair clipper 10. These bottom ribs 62 form a kind of grating that may be used to place the comb 20 on the user's head. These bottom ribs 62 may thus glide over the scalp of the user. This makes it easy to orientate the comb 20 correctly and serves for an even haircut. As shown in FIG. 9 the bottom ribs 62 of the comb 20 are not directly connected to the comb teeth 30, such that a gap occurs below the cutting assembly. This enables for even shorter haircut lengths. It shall be noted, however, that the gap in between the comb teeth 30 and the bottom ribs 62 is not mandatory. Each comb tooth 30 may also be directly connected to a respective bottom rib 62. This is especially advantageous for longer haircut lengths, as such an uninterrupted comb attachment 20 has an increased mechanical stability.

The second embodiment shown in FIG. 10 is improved with respect to a clogging prevention. According to this embodiment the comb attachment 20 comprises two arms 64, 64' that may be slightly curved and jut out of the backside 34 of the comb attachment 20. One arm 64, 64' is arranged on each lateral side of the comb attachment 20 (one on the left and one on the right side). Similar as the bottom ribs 62, these arms 64, 64' overlap the distal end 16 of the housing 12, when the comb 20 is attached to the hair clipper 10. The space in between the two arms 64, 64' (indicated by reference numeral 66) is in contrast to the first embodiment left open. This open underside of the comb offers a free hair flow for cut hairs, so that they may immediately fall down through the open hole 66 in between the arms 64, 64'. Also uncut hairs have a free hair flow out of the comb 20, because its bottom side is open. Especially with longer hairs this is creating a free hair flow without manipulating the uncut hairs which could negatively influence the efficiency. The comb 20 according to the second embodiment shown in FIG. 10 therefore further improves the clogging prevention that is targeted by the present invention.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping device comprising:

a housing having an upper side and a housing back side opposite the upper side;

a cutting assembly arranged on a distal end of said housing over the upper side of the housing, the cutting assembly having a stationary cutting blade and a moveable cutting blade extending in a direction from the housing back side towards the upper side; and a comb attachment releasably attachable to the housing and having comb teeth that extend along a longitudinal axis of the housing, wherein the upper side of the housing runs transverse to the distal end and the cutting assembly, and comprises a corrugated surface with a plurality of adjacent ribs and recesses running parallel to each other and parallel to the longitudinal axis of the housing and to the comb teeth when the comb attachment is attached to the housing, wherein the comb teeth are closer to the upper side of the housing than the housing back side, and wherein a front side of the comb teeth faces away from the housing and an opposing backside of the comb teeth contacts the corrugated surface of the upper side when the comb attachment is attached to the housing.

2. The hair clipping device according to claim 1, wherein the ribs and recesses run substantially parallel to a longitudinal direction of the housing.

3. The hair clipping device according to claim 1, further comprising an adjustment mechanism for adjusting the position of the comb attachment relative to the housing along a longitudinal direction of the ribs and recesses.

4. The hair clipping device according to claim 3, wherein the adjustment mechanism is configured to set the comb attachment in a plurality of different positions relative to the housing wherein the backside of the comb teeth contacts the corrugated surface in each of said plurality of positions.

5. The hair clipping device according to claim 1, wherein the comb teeth of the comb attachment run parallel to the ribs and recesses when the comb attachment is attached to the housing.

6. The hair clipping device according to claim 1, wherein the comb teeth of the comb attachment are at least partly received within the recesses when the comb attachment is attached to the housing, such that the backside of each comb tooth contacts a base of a respective one of the recesses.

7. The hair clipping device according to claim 6, wherein the comb teeth of the comb attachment have a width that substantially equals a width of the recesses.

8. The hair clipping device according to claim 1, wherein the ribs jut out of the upper side of the housing.

9. The hair clipping device according to claim 1, the backside of each comb tooth contacts an upper side of a respective one of the ribs when the comb attachment is attached to the housing.

10. The hair clipping device according to claim 9, the comb teeth of the comb attachment have a width that substantially equals or exceeds a width of the ribs.

11. The hair clipping device according to claim 1, wherein the stationary cutting blade comprises cutting teeth, wherein each of the ribs comprises an upper side facing away from the housing, and wherein an imaginary plane in which said upper sides of the ribs come to lie contacts a tip of the cutting teeth of the stationary cutting blade.

12. The hair clipping device according to claim 11, wherein the recesses are recessed with respect to the apex of the ribs and said imaginary plane.

13. The hair clipping device according to claim 1, wherein the comb attachment comprises two arms that jut out of the backside of the comb attachment one at each lateral side of the comb attachment towards the housing back side, such that said arms overlap the distal end of the housing when the comb attachment is attached to the housing, and wherein the space between said two arms is left open.

* * * * *